United States Patent [19]

Nytomt et al.

[11] Patent Number: 4,565,179

[45] Date of Patent: Jan. 21, 1986

[54] APPARATUS IN MAGNETO IGNITION SYSTEMS FOR PROVIDING TIME-SEPARATED SEQUENCES FOR CHARGING AND TRIGGERING IN CO-PHASED CHARGING AND TRIGGERING VOLTAGE SEQUENCES, INCLUDING INHIBITION OF THE IGNITION SEQUENCE IN SUCH APPARATUS

[75] Inventors: Jan G. Nytomt; Lars-Olof Ottosson; Nils A. Agren, all of Åmål, Switzerland

[73] Assignee: Aktiebolaget Svenska Elektromagneter, Åmål, Sweden

[21] Appl. No.: 511,642

[22] Filed: Jul. 7, 1983

[51] Int. Cl.[4] ..... F02P 3/06

[52] U.S. Cl. ..... 123/599; 123/198 DC; 315/209 CD; 315/218

[58] Field of Search ..... 123/599, 198 DC, 630; 315/209 CD, 218

[56] References Cited

U.S. PATENT DOCUMENTS

| | | | |
|---|---|---|---|
| 3,828,753 | 8/1974 | Reddy | 123/599 |
| 3,900,016 | 8/1975 | Haubner et al. | 123/599 |
| 3,960,128 | 6/1976 | Anderson et al. | 123/198 DC |
| 3,974,816 | 8/1976 | Henderson et al. | 123/599 |
| 4,116,188 | 9/1978 | Nagasawa | 123/148 CC |
| 4,193,385 | 3/1980 | Katsumata et al. | 123/198 DC |

*Primary Examiner*—Andrew M. Dolinar

*Attorney, Agent, or Firm*—Hill, Van Santen, Steadman & Simpson

[57] ABSTRACT

Apparatus in magneto ignition systems for providing time separated sequences for charging and triggering in cophased charging and triggering voltage sequences, including inhibition of the ignition sequence in such apparatus. The ignition system includes a triac as a control member, a rectifier being included in the control circuit of the triac, the rectifier having its polarity disposed such that time-separated charging and triggering intervals are obtained. Across the rectifier there is connected a short-circuiting circuit or providing triggering control voltages to the triac, even during the charging interval, thus preventing charging, which results in inhibition of the ignition sequence.

2 Claims, 2 Drawing Figures

APPARATUS IN MAGNETO IGNITION SYSTEMS FOR PROVIDING TIME-SEPARATED SEQUENCES FOR CHARGING AND TRIGGERING IN CO-PHASED CHARGING AND TRIGGERING VOLTAGE SEQUENCES, INCLUDING INHIBITION OF THE IGNITION SEQUENCE IN SUCH APPARATUS

BACKGROUND OF THE INVENTION

(a) Field Of The Invention

Prior Art

In conjunction with flywheel magneto systems there is always a problem of being able to achieve as large a number of operation and control functions as possible while using a minimum number of components in the relatively small space available. Accordingly, from the design and construction aspect it is suitable to concentrate voltage generating windings on one core and in one magnetic path (one circuit). From the aspect of winding technique it is further advantageous if several coils can be wound in the same winding direction. The patent literature contains many solutions to the problem mentioned above. The ignition systems customarily used in such connections are so-called capacitive ignition systems, i.e. systems in which the potential energy stored in a capacitor is utilized for providing an ignition spark. The prevailing construction of such ignition systems includes the arrangement of a charging winding in the existing flywheel magneto, this winding generating charging voltage to a capacitor via a rectifier. The capacitor is connected to the primary circuit in an ignition transformer and forms, together with a thyristor, a series circuit for a subsequent discharge of the charged state in the capacitor. The thyristor gets its control voltage from a trigger winding in the system, which generates voltage pulses for triggering the thyristor.

The simplest solution for inhibiting an ignition sequence in a circuit according to the prior art is to short-circuit or bypass the charge capacitor. This is not suitable in practice however, since there may be potentials of up to 400 volts and more across the charge capacitor. For the sake of safety, such voltage levels should not be lead out to stop button functions for manual operations. The next solution nearest available is to keep a thyristor in a system in a non-conductive state in some way, to prevent the capacitor discharge. In this connection there occurs the problem that for smoothing out overvoltages occurring during retarding the engine and for this purpose a varistor or the like must be arranged across the charging rectifier.

SUMMARY OF THE INVENTION

The present invention is an improved solution of the foregoing problems. However, the invention also solves the problem of simply and positively providing inhibition of the ignition sequence so that an associated internal combustion engine is stopped rapidly and positively. A practical field of application for the present invention is that of hand-held power saws. Inhibition of the ignition sequence can be provided without the addition of further electronic components to the circuit.

The present invention is based on the use of a triac component instead of the thyristor as the controlling element in the circuit. Charging a capacitor is arranged to take place as known in the art, but with the use of the triac component, a back rectifier may be dispensed with, and possibly also the varistor conventionally used for preventing injurious reverse voltages. A triac component has the property of being able to be conductive in two directions, but is able to block current flow if no control voltage is present on its control electrode. In the circuit generating trigger voltages, a rectifier is in series with the triac component's control electrode. The charge voltage generating circuit as well as the triggering circuit are co-phased, i.e. their voltage build-ups will start at substantially the same time. By arranging the rectifier in the triggering circuit and appropriate phase disposition between charging and triggering, the triac component is put on-state in the interval after the charging sequence has been accomplished. This means that a spark is obtained in the interval after changing.

In accordance with the present invention, there is a short-circuiting circuit across the rectifier in the triggering circuit which, when it is shorted, allows control pulses to the triac component during all phase conditions, i.e. also during the build-up interval for the charge voltage. This means that the triac component will be on-state during all the intervals critical for charging, resulting in that no ignition energy can be stored in the capacitor and no spark can thus be triggered. The voltage levels which are present in conjunction with the trigger voltage amount only to some few volts in practice, there thus being no safety problems at all in leading this voltage to manual control switches, even in damp conditions.

The invention is described in detail with reference to the accompanying drawing, schematically illustrating an embodiment of the invention.

ON THE DRAWINGS

AS SHOWN OF THE DRAWINGS

Figure 1:
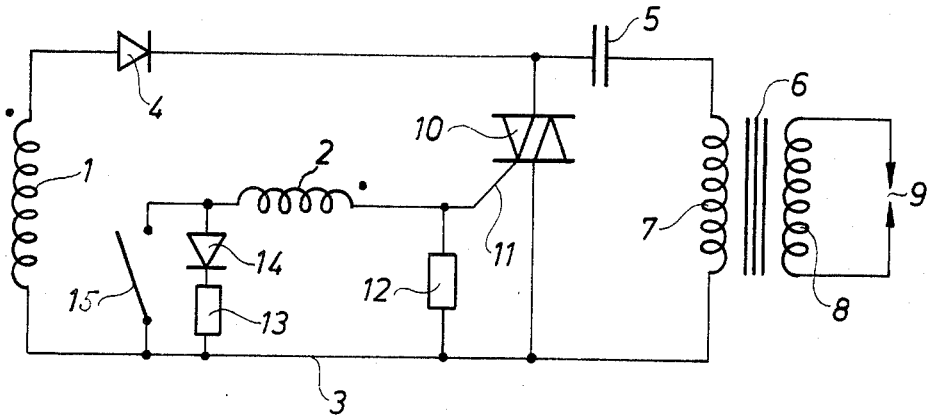
FIG. 1 illustrates a wiring diagram for an apparatus in accordance with the invention.

The circuit illustrated in FIG. 1 applies to a flywheel magneto system in which there are both a charging winding 1 and a triggering winding 2 in the same magnetic circuit. One side of the charging winding is connected to a conductor 3, common to the whole system, and its other end to a charging rectifier 4 connected in series with a charging capacitor 5, which is in turn connected to one end of the primary winding 7 of an ignition transformer 6. The other end of the primary winding 7 is connected to the common conductor 3. The ignition transformer is conventionally provided with a secondary winding 8 with connections to a spark gap 9. A triac 10 is connected between the charging rectifier 4 and the capacitor 5, the triac also being connected to the common conductor 3. The control electrode 11 of the triac is connected to one end of the triggering winding 2 and is also connected to the common conductor 3 via a resistor 12. Between the common conductor 3 and the other end of the triggering winding 2 there is a resistor 13 and a rectifier 14 connected in series. A short-circuiting circuit including a switch 15 is arranged across that rectifier 14.

Figure 2:
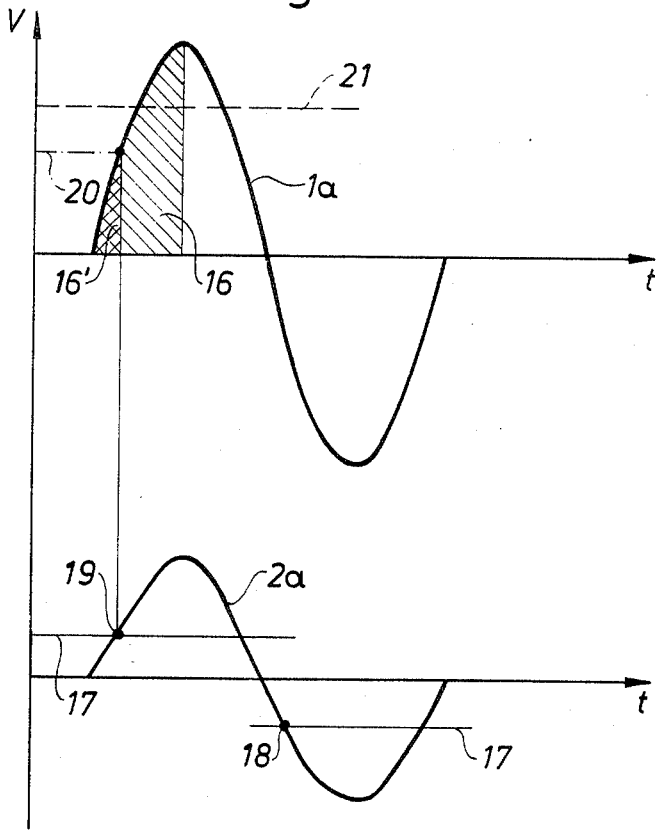
FIG. 2 illustrates voltage-time curves occurring during operation of the apparatus.

The apparatus functions in the following manner. It is assumed that the voltages generated in the windings 1 and 2 have a cycle as illustrated in FIG. 2, of which the upper curve illustrates the voltage cycle for the charging winding 1 and the lower curve the voltage cycle for the triggering winding 2. As shown in the drawings both cycles are in phase with each other. During the first half-period of curve 1*a*, current flows from the winding 1 through the rectifier 4 to the capacitor 5, which is thus charged. During the interval in question, there is no voltage on the control electrode 11 of the triac 10, since the rectifier 14 blocks the current flow. It is assumed here that the switch 15 is in its open position. The hatched portion 16 of the first half-period in curve 1*a* thus represents the charging interval for the capacitor 5. In the consecutively following half-period, the rectifier 4 blocks any current flow, while the voltage simultaneously built up in the trigger winding 2 reaches a trigger level 17, the triac being energized to go from off-state to on-state at the point 18 on curve 2*a*. Under this condition, the capacitor 5 will discharge via the triac 10 to the primary winding 7 of the ignition transformer 6, to provide a spark at the gap 9. The capacitor 5 is charged in an equivalent manner during the next half-period, and the sequences or cycles are repeated. There is provided in the manner described an efficient separation of charging and triggering sequences since these are separated by a phase shift of about half a period. The function of the resistor 13 is to smooth out control sequences in the circuit.

If it is now desired to stop the engine by inhibiting the ignition function, the switch 15 is closed, which is equivalent to short-circuiting the rectifier 14. What happens then is apparent from FIG. 2. As previously described, a charge built-up voltage is induced in the charging winding 1 during the first half-period. An equivalent voltage is also built up in the trigger winding 2. However, when the trigger voltage has attained a value previously indicated at 17, the triac 10 is activated to go from off-state to on-state. This takes place at the point 19 on the curve 2*a*. If the same time is plotted on the curve 1*a*, a voltage level 20 is arrived at for the capacitor 5, the charge 16' being now tapped due to the triac being on-state. The lowest voltage level required for providing a charge sufficient for a spark jump is marked by the dashed line 21 in the first part of curve 1*a*. The voltage level 20 is considerably lower than the lowest ignition voltage level 21, which means that there is no risk of charging the capacitor to its ignition function level. The conditions once obtained are maintained independent of the rate of revolutions of the engine, i.e. independent of the curve growth due to higher voltage induction, since in such cases the trigger point always accompanies the trigger voltage, resulting in an earlier disposition of the triggering sequence. In this regard the resistor 13 has the function of reducing the normal triggering pulses in relation to the pulses during the short-circuiting conditions, whereby a more secure stopping function is achieved.

The voltages in the illustrated example are in phase, but this is not necessary for carrying out the invention, since the only requirement for the invention is that the charging and triggering voltages shall be in co-phase, i.e. they shall have substantially the same instant for passage through zero. The interval during which triggering takes place is of course entirely dependent on the connection of the triggering coil 2 and the arrangement of the polarity in the rectifier 14. Such embodiments may be comtemplated where the triac member 10 is replaced by a component equivalent thereto.

We claim:

1. In a flywheel magneto system, the combination comprising:

(a) a charging circuit connected through a storage capacitor to an ignition transformer;

(b) a triac connected across said capacitor for discharging it through said transformer, and having a control terminal;

(c) a control circuit co-phased with said charging circuit and having a rectifier connected to said control terminal, the polarity of said rectifier being such that said rectifier comprises a means for enabling a voltage build-up in said control circuit after the charging interval for said storage capacitor to trigger said triac;

(d) a selectively open or closed short-circuiting switch connected across said rectifier in said control circuit, whereby said closed short-circuiting switch provides a control voltage on said control terminal of said triac to put it in an on-state during the initial portion of the capacitor charging interval to terminate charging before ignition triggering voltage is reached, thus terminating ignition;

(e) each of said charging and control circuits having an induction winding;

(f) a common conductor connected to (1) one pole of said triac, (2) the primary winding of said ignition transformer, (3) the cathode of said rectifier, (4) said charging induction winding, and (5) one side of said short-circuiting switch;

(g) said control induction winding connecting said control terminal of said triac to the anode of said rectifier; and (h) the other side of said short-circuiting switch being connected to the connection of the anode of said rectifier to said control induction winding.

2. In a system according to claim 1, including a resistor connected in series with said rectifier for smoothing out triggering signals in said control circuit.

* * * * *